US006518869B1

(12) United States Patent
Warabi

(10) Patent No.: US 6,518,869 B1
(45) Date of Patent: Feb. 11, 2003

(54) POWER SUPPLY TRANSFORMER FOR TELEPHONE

(75) Inventor: Koji Warabi, Iruma (JP)

(73) Assignee: Tamura Corporation, Tokyo (JP)

( * ) Notice: Subject to any disclaimer, the term of this patent is extended or adjusted under 35 U.S.C. 154(b) by 0 days.

(21) Appl. No.: 09/493,552

(22) Filed: Jan. 28, 2000

(30) Foreign Application Priority Data

Feb. 4, 1999 (JP) ..... 11-026811

(51) Int. Cl.[7] ..... H01F 27/30

(52) U.S. Cl. ..... 336/198; 336/65; 336/170; 336/180; 336/208

(58) Field of Search ..... 336/92, 107, 192, 336/198, 65, 69, 185, 206, 208, 170; 363/81; 323/247, 251

(56) References Cited

U.S. PATENT DOCUMENTS

| | | | | | |
|---|---|---|---|---|---|
| 3,711,806 | A | * | 1/1973 | Flentge | 336/198 |
| 4,500,833 | A | | 2/1985 | Napp et al. | |
| 4,611,097 | A | * | 9/1986 | Grimes | 363/97 |
| 4,912,447 | A | * | 3/1990 | Paul | 336/69 |
| 5,534,839 | A | * | 7/1996 | Mackin et al. | 336/192 |
| 5,805,431 | A | * | 9/1998 | Joshi et al. | 361/836 |

FOREIGN PATENT DOCUMENTS

| | | | |
|---|---|---|---|
| DE | 31 29 381 C2 | | 10/1989 |
| DE | 0350767 | * | 1/1990 |
| DE | 4021860 | * | 1/1992 |
| DE | 29709418 | * | 9/1997 |
| DE | 297 09 418 U1 | | 9/1997 |
| JP | 04354236 A | | 8/1992 |
| JP | 06284230 A | | 3/1993 |
| JP | 06062155 A | | 4/1994 |
| JP | 06303185 A | | 10/1994 |
| JP | 6-314623 | * | 11/1994 |

* cited by examiner

*Primary Examiner*—Michael Friedhofer
*Assistant Examiner*—Tuyen T. Nguyen
(74) *Attorney, Agent, or Firm*—Dennis G. LaPointe; Mason Law, P.A.

(57) ABSTRACT

A power supply transformer for telephone to be incorporated in an AC adapter as a power supply for a telephone. A bobbin used in a power supply transformer for a telephone is configured by taking insulation as well as an insulation distance into consideration and is partitioned into three winding frames with a plurality of flanges to configure. A primary side input coil, which is connected with a power supply for commercial use, is coiled at the coil portion of the bobbin, a secondary side output coil is coiled for charging at another coil portion, and a secondary side output coil is coiled for a telephone line at still another coil portion are deemed to serve for improvement in insulation and reservation of insulation distance mutually between the respective coils. The output coil on secondary side for telephone line functions as a supplying power of a modem of the telephone set via a rectifying portion so that the modem directly connected with the telephone line can maintain insulation as well as insulation distance.

13 Claims, 2 Drawing Sheets

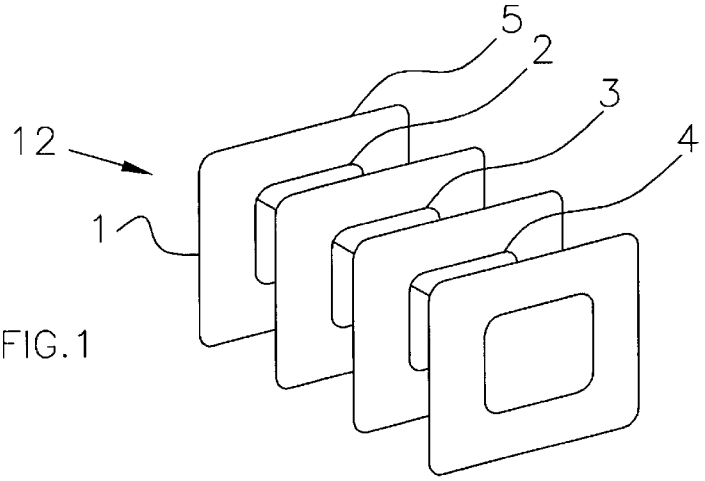
FIG.1
FIG.2
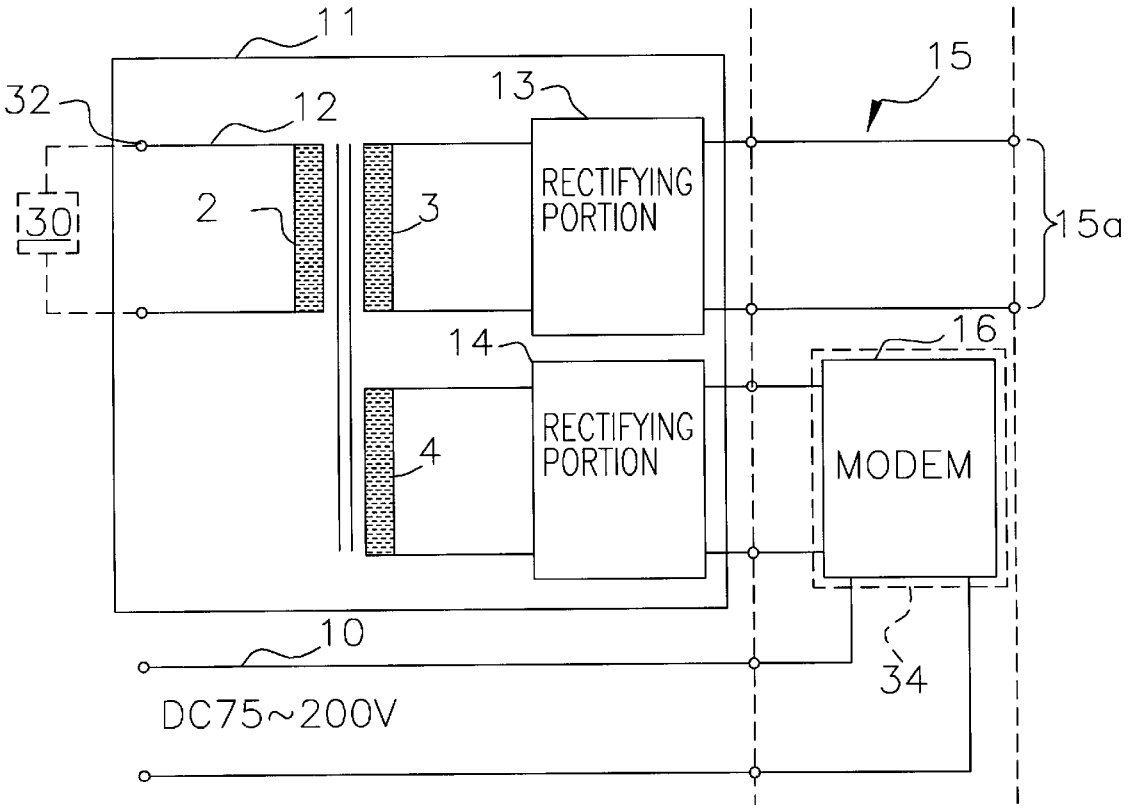

PRIOR ART

POWER SUPPLY TRANSFORMER FOR TELEPHONE

BACKGROUND OF THE INVENTION

1. Field of the Invention

The present invention relates to a power supply transformer for a telephone to be incorporated in an AC adapter as a power supply for the telephone.

2. Description of the Prior Art

FIG. 3 is a block diagram showing a configuration of a power supply system related to a telephone set using a power supply transformer for a telephone according to a conventional example. In the drawings, an AC adapter 21, is configured by a power supply transformer 22 and a rectifying portion 23, etc., and converts a commercial power supply (AC120V60 Hz) which is an input into a predetermined DC voltage to be outputted.

In a charging stand 25, there are installed a stabilizing power supply 27, which stabilizes a DC output from the AC adapter 21 to implement outputting to a charging terminals 25*a*, and a modem 16 of the telephone set, which receives a power supply from this stabilizing power supply 27, or the like. In an extension phone of the telephone set, etc., which is displaced on the charging stand 25, a built-in battery is charged with charging currents from the charging terminals 25*a*.

The modem 16 implements modulation-demodulation between a telephone line 10 and the telephone set for DC voltages of 75 to 200 V via a line transformer 28.

Thus, insulation (for the telephone set) is implemented by using separate transformers respectively for a commercial power supply line (AC 120 V in 60 Hz) and the telephone line 10.

However, safety standards on electric insulation were intensified so as to give rise to a necessity that the sufficient insulation distance between a primary side and a secondary side should be also secured as to the line transformer 28 inserted between the telephone line 10 and the modem 16.

BRIEF SUMMARY OF THE INVENTION

Object of the Invention

Contemplating on such points, the present invention is accomplished, and the purpose of the present invention is to provide a new power supply transformer for telephone in order to realize good cost performance while complying with the standards of the power supply system related to the telephone set caused by strengthening the safety standards.

SUMMARY OF THE INVENTION

It is also one of measures for the safety standards to improve the line transformer 28 inserted between the telephone line 10 and the modem 16 to secure insulation distance on insulation between a primary side and a secondary side. However, according to the present application, the power supply transformer for telephone is configured by respectively independent two secondary side circuits, and one is used for charging as in a conventional one and the other is used for power supply to the modem 16. This enables the telephone line 10 to directly connect with the modem 16 by omitting the line transformer 28.

BRIEF DESCRIPTION OF THE DRAWINGS

FIG. 1 is a schematic block diagram showing a power supply transformer for telephone in an embodiment of the present invention;

FIG. 2 is a block diagram showing a configuration of a power supply system related to a telephone set using a power supply transformer for telephone according to the present invention.

DETAILED DESCRIPTION OF THE PREFERRED EMBODIMENT

Figure 3:
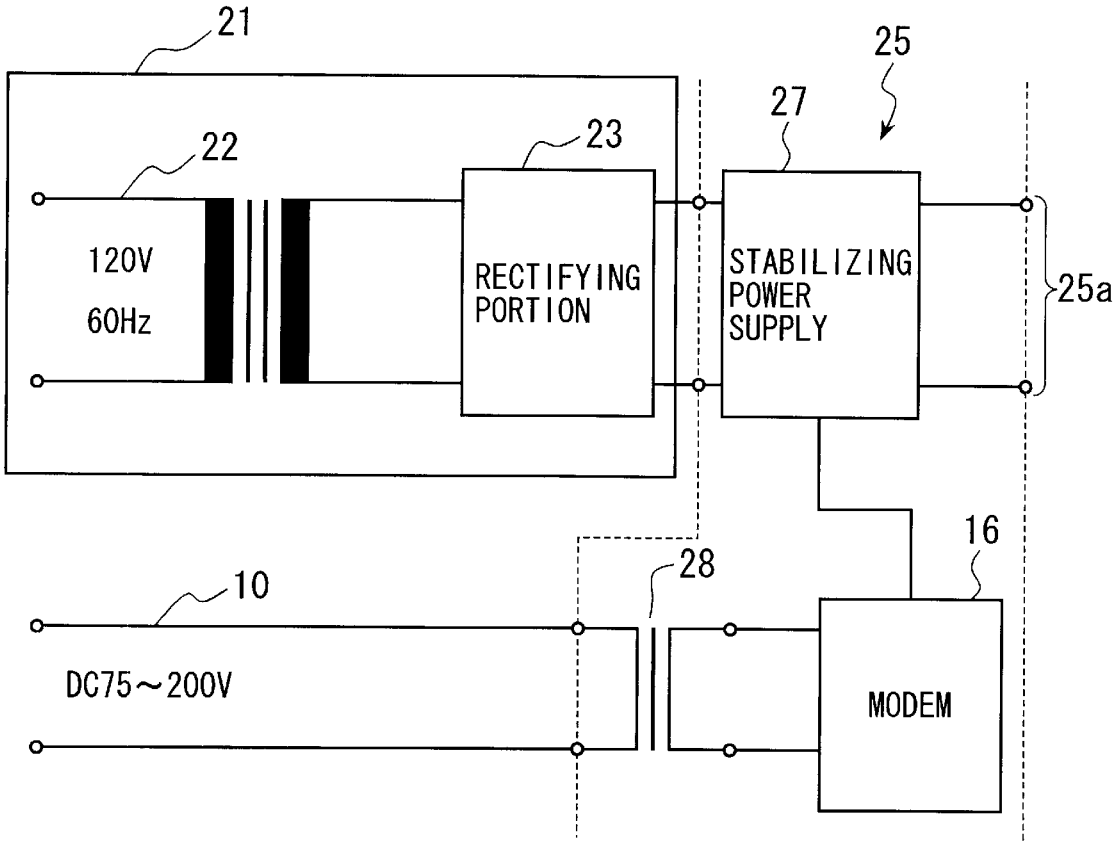
FIG. 3 is a block diagram showing a configuration of a power supply system related to a telephone set using a power supply transformer for telephone according to a conventional example.

In order to solve the above described problems, the power supply transformer for a telephone of the present invention is provided with a bobbin 1 having a plurality of flanges 5 to configure a plurality of winding frames so as to secure sufficient insulation as well as insulating distance in a power supply transformer for the telephone to be incorporated in an AC adapter as a power supply for telephone, that is, insulation between a primary side input coil 2, a secondary side output coil 3 for charging and a secondary side output coil 4 for a telephone line is insured, wherein a primary side input coil 2, which is independently connected with a power supply for commercial use, is coiled at the coil portion being one of winding frames of this bobbin 1, a secondary side output coil 3 is independently coiled far charging at the coil portion being another winding frame, and a secondary side output coil 4 is independently coiled for a telephone line at the coil portion being still another winding frame so that improvements in insulation and reservation of the insulation distance mutually between the respective coils 2 through 4, each of which has been wound independently around the respective winding frame of the bobbin 1, have been planned or predetermined to ensure safe operating characteristics.

Embodiment

An embodiment of the present invention will be described as follows based on the drawings. FIG. 1 is a schematic block diagram showing a power supply transformer for a telephone in an embodiment of the present invention. In the drawing, the bobbin of the power supply transformer for telephone is denoted as 1, and is partitioned into three winding frames with the flanges 5.

The primary side input coil 2 to be connected with a commercial power supply is coiled around the coiling portion being one of the winding frames, and the secondary side output coil 3 is coiled for charging around the coiling portion being another winding frame, and the secondary side output coil 4 is coiled for a telephone line around the coiling portion being still another winding frame. Accordingly, a spacer (between a coil and the steel core) to secure the insulation distance can be attached thereto. This bobbin 1 of the power supply transformer for telephone is a bobbin which is aimed to undergo coiling for a telephone line (modem) around any of coils partitioned into three or more, and the coils with which the respective winding frames are coiled are designed in accordance with purposes.

FIG 2 is a block diagram showing a configuration of a power supply system related to a telephone set 34 using a power supply transformer for a telephone according to the present invention. In the drawing, an AC adapter 11, which comprises a power supply transformer 12, a first rectifying portion 13, a second rectifying portion 14 or the like, converts the commercial power supply being the input into predetermined direct-current voltages to output them respectively.

A DC output from the first rectifying portion 13 of the AC adapter 11 is connected with charging terminals 15*a* of a charging stand 15, and a DC output from the other second rectifying portion 14 of the AC adapter 11 functions as the power supplying source for a modem 16 of a telephone set 34. Moreover, the modem 16 is connected directly with a telephone line 10.

The power supply transformer 12 for telephone 34 according to the present invention, which is incorporated in an AC adapter for the power supply for a telephone, is sufficiently provided with insulation as well as insulation distances between respective coils 2 through 4 in a secured fashion. That is, the modem 16, which is directly connected with the telephone line 10, is completely separately independent from the primary side input coil 2 of the power supply transformer 12 for the telephone and the secondary side output coil 3 for charging. Accordingly, the modem 16, which is connected directly with the telephone line 10, can sufficiently comply with a intensified safety standards on a power supply system related to a telephone set.

As having been described so far, in the power supply transformer for a telephone according to the present invention, since the bobbin 1 having the plurality of flanges 5 to configure a plurality of winding frames so as to secure sufficient insulation as well as insulating distance, and the primary side input coil 2, which is independently connected (32) with a power supply 30 for commercial use, is coiled at the coil portion being one of winding frames of this bobbin 1, the secondary side output coil 3 is independently coiled for charging at the coil portion being another winding frame, and the secondary side output coil 4 is independently coiled for a telephone line at the coil portion being still another winding frame so that improvements in insulation and the reservation of insulation distance mutually between the respective coils 2 through 4, each of which has been coiled independently around the respective winding frame of the bobbin 1, has been planned, it can realize good cost performance while it sufficiently complies with a locally intensified safety standards on a tower supply system related to telephone set, compared with securing the insulation distance between the primary side and the secondary side of the line transformer 28 which is inserted between the telephone line 10 and the modem 16.

What is claimed is:

1. A telephone power supply transformer to be incorporated into an AC adapter as a power supply for telephones, comprising:

a bobbin, which is partitioned into a plurality of winding frames by means of a plurality of flanges, a primary side input coil, which is connectable with a commercial power supply, being coiled at a first winding frame of said bobbin;

a first secondary side output coil being coiled at a second winding frame of said bobbin; and a second secondary side output coil being coiled at a third winding frame of said bobbin, wherein the first secondary side output coil and the second secondary side output coil are not connected with each other so as to respectively ensure an appropriate insulation and a mutual insulation distance between the respective coils.

2. The power supply transformer according to claim 1, wherein said first and said second secondary side output coils each include a rectifying portion.

3. The power supply transformer according to claim 2, wherein a DC output from a first rectifying portion is connectable with charging terminals of a charging stand.

4. The power supply transformer according to claim 3, wherein a DC output from a second rectifying portion functions as a power supplying source for a modem of a telephone set.

5. The power supply transformer according to claim 2, wherein a DC output from one of the rectifying portions functions as a power supplying source for a modem of a telephone set.

6. The power supply transformer according to claim 2, wherein a DC output from one of the rectifying portions is connectable with charging terminals of a charging stand.

7. An AC adapter as a power supply for telephones comprising:

a power supply transformer comprising:

a bobbin, which is partitioned into a plurality of winding frames by means of a plurality of flanges, a primary side input coil, which is connectable with a commercial power supply, being coiled at a first winding frame of said bobbin;

a first secondary side output coil being coiled at a second winding frame of said bobbin; and a second secondary side output coil being coiled at a third winding frame of said bobbin, wherein the first secondary side output coil and the second secondary side output coil are not connected with each other so as to respectively ensure an appropriate insulation and a mutual insulation distance between the respective coils.

8. The AC adapter according to claim 7, wherein said first and said second secondary side output coils each include a rectifying portion.

9. The AC adapter according to claim 8, wherein a DC output from a first rectifying portion is connectable with charging terminals of a charging stand.

10. The AC adapter according to claim 9, wherein a DC output from a second rectifying portion functions as a power supplying source for a modem of a telephone set.

11. The AC adapter according to claim 8, wherein a DC output from one of the rectifying portions functions as a power supplying source for a modem of a telephone set.

12. The AC adapter according to claim 8, wherein a DC output from one of the rectifying portions is connectable with charging terminals of a charging stand.

13. A power supply transformer for a telephone to be incorporated into an AC adapter as a power supply for the telephone comprising:

a bobbin structured by three winding frames partitioned by four flanges, the bobbin including a primary side input coil and two secondary side output coils, each coil forming a coil portion, each coil portion being one of the three winding frames partitioned by a pair of the four flanges and insulated from each other so as to insure an insulation distance between each of the primary side input coil and each of the two secondary side output coils, the winding frame formed by the coil portion forming the primary side input coil being located on one end of the bobbin; and the winding frames formed by the coil portions forming the two secondary side output coils being located one at a center of the bobbin and the other at an end of the bobbin opposite the location of the winding frame formed.by the coil portion forming the primary side input coil, wherein the primary side input coil is in electrical communication with a commercial power supply, wherein one of the two secondary side output coils is independently coiled for charging, and wherein the other secondary side output coil is independently coiled at its formed coil portion, wherein each secondary side output coil has a rectifying portion, and a direct current output from one of the rectifying portions is connected to a charging stand, while the other is electrically connected to a telephone line.

* * * * *

UNITED STATES PATENT AND TRADEMARK OFFICE

CERTIFICATE OF CORRECTION

PATENT NO. : 6,518,869 B1
DATED : February 11, 2003
INVENTOR(S) : Koji Warabi

It is certified that error appears in the above-identified patent and that said Letters Patent is hereby corrected as shown below:

Column 2,
Line 20, replace “far” with -- for --.

Column 3,
Line 30, replace “tower” with -- power --.

Column 4,
Line 52, replace “formed. by” with -- formed by --.

Signed and Sealed this

Twenty-fifth Day of March, 2003

JAMES E. ROGAN
*Director of the United States Patent and Trademark Office*